US007400187B1

(12) United States Patent
Chen

(10) Patent No.: US 7,400,187 B1
(45) Date of Patent: Jul. 15, 2008

(54) LOW VOLTAGE, LOW Z, BAND-GAP REFERENCE

(75) Inventor: Sean S. Chen, Sunnyvale, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 09/970,297

(22) Filed: Oct. 2, 2001

(51) Int. Cl.
*G05F 1/10* (2006.01)

(52) U.S. Cl. ..... 327/539; 323/313

(58) Field of Classification Search ..... 327/539–543; 323/313–316

See application file for complete search history.

(56) References Cited

U.S. PATENT DOCUMENTS 3,886,001 A * 5/1975 Dobkin ..... 438/383
4,422,033 A * 12/1983 Minner et al. ..... 323/314
4,683,416 A * 7/1987 Bynum ..... 323/314
5,448,196 A * 9/1995 Kanbara et al. ..... 327/231
5,451,859 A * 9/1995 Ryat ..... 323/312
5,517,143 A * 5/1996 Gross ..... 327/108
5,602,466 A * 2/1997 Edwards ..... 323/313
5,621,308 A * 4/1997 Kadanka et al. ..... 323/313
5,666,046 A * 9/1997 Mietus ..... 323/313
5,751,182 A * 5/1998 Thiel, IV ..... 327/142
5,834,927 A * 11/1998 Sugawara ..... 323/314
5,920,184 A * 7/1999 Kadanka ..... 323/314
6,118,264 A * 9/2000 Capici ..... 323/316
6,150,872 A * 11/2000 McNeill et al. ..... 323/313
6,433,621 B1 * 8/2002 Smith et al. ..... 323/315

* cited by examiner

*Primary Examiner*—N. Drew Richards
*Assistant Examiner*—Thomas J Hiltunen

(57) ABSTRACT

The present invention relates to a low impedance band-gap voltage reference circuit which comprises a band-gap reference circuit, a buffer circuit to reduce the impedance and related noise associated with band-gap references electronically coupled with the band-gap voltage reference circuit and a voltage pull-up device electronically coupled with both the band-gap reference circuit and the buffer circuit. The voltage pull-up device acts to reduce the supply voltage required to maintain a stable, low Z band-gap reference voltage.

16 Claims, 3 Drawing Sheets

LOW VOLTAGE, LOW Z, BAND-GAP REFERENCE

FIELD OF THE INVENTION

The present invention relates to the field of integrated circuit design.

BACKGROUND OF THE INVENTION

In the arena of complex integrated circuits, there are sometimes portions of circuits that require voltage references for proper functioning. A voltage reference provides a precise output voltage, one that is much more accurate than can be produced by a voltage regulator. Its output voltage is compared to other voltages in a system and, usually, adjustments are made to those other voltages based on the reference difference. References are similar to regulators in how they function, but they are used much differently. While regulators are used to deliver power to a load, references are normally used with a small, stable load (if any) to preserve their precision. Only a few of the existing reference designs have the capability to deliver a load greater than a few milliamps while maintaining a precision output voltage. A reference is not used to supply power but to provide a system with an accurate analog voltage for comparison purposes. The band-gap reference circuit has long been used in integrated circuits for that purpose.

A band-gap reference takes advantage of the electrochemical properties of a material. In a semiconductor, the amount of energy which allows the material to become conductive, i.e. move current in the presence of a voltage, is known as the band gap energy. The band gap energy is different for a variety of materials. However, silicon, the foundation material for a preponderance of integrated circuits, has a predictable band-gap energy that changes little with temperature over most of the temperature range of normal integrated circuit operations.

The band-gap reference is widely used in almost every application of IC technology. One common method of band-gap implementation is use of current generated by the delta $V_{be}$ of a pair of unijunction transistors which essentially function as diodes. The current then flows through a diode chain to achieve a constant reference band-gap voltage. A significant problem with such simple reference circuits is a high output impedance which can change the reference behavior if the band-gap reference circuit were connected to a high noise stage.

Some early band-gap reference circuits used conventional junction-isolated bipolar-IC technology to make relatively stable low-voltage references. This type of reference became popular as a stable voltage reference for low-voltage circuits, such as in 5-volt data acquisition systems where zener diodes were not suitable.

A common failing in band-gap reference circuits, as mentioned above, is a characteristically high impedance that results in a noisy circuit. Because the demands on a reference get ever tighter with higher precision circuits, a stable low-noise performance is crucial.

Another common failing of band-gap circuits is the requirement for a relatively high VCC, substantially higher than the reference voltage. Since a band-gap voltage is almost always very close to 1.2 volts, a minimum value for VCC is usually somewhere around 2 volts. Since modern digital ICs using 1 volt technology are becoming daily more common, the requirement for a higher VCC can be a design limitation.

What is needed, then, is a band-gap reference circuit that has an innate low impedance to allow for stable low-noise operation. A further need exists for a band-gap reference circuit that can produce a usable reference voltage while being powered by a low supply voltage.

SUMMARY OF THE INVENTION

Presented herein is a band-gap reference circuit that has an innate low impedance to allow for stable low-noise operation. This novel band-gap reference circuit can produce a usable, low noise, reference voltage while being powered by a low supply voltage.

The present invention relates to a low impedance band-gap voltage reference circuit which comprises a band-gap reference circuit, a buffer circuit to reduce the impedance and related noise associated with band-gap references electronically coupled with the band-gap voltage reference circuit and a voltage pull-up device electronically coupled with both the band-gap reference circuit and the buffer circuit. The voltage pull-up device acts to reduce the supply voltage required to maintain a stable, low Z band-gap reference voltage.

These and other objects and advantages of the present invention will become obvious to those of ordinary skill in the art after having read the following detailed description of the preferred embodiments which are illustrated in the various drawing figures.

BRIEF DESCRIPTION OF THE DRAWING

The operation and components of this invention can be best visualized by reference to the drawing.

DETAILED DESCRIPTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well-known methods, procedures, components, and circuits have not been described in detail so as not to unnecessarily obscure aspects of the present invention.

The embodiments of the present invention discussed herein relate to the electronic characteristics of the semiconductor material from which integrated circuit devices are formed. Modern integrated circuit devices are typically very small and work in very low voltages. Most modern integrated require a stable voltage reference. In some cases, modern digital devices can draw a logic distinction between voltages differing by fractions of volts. Some analog or hybrid devices, such as ADCs (analog to digital converters) or DAC s (digital to analog converters), however, can be required to make much smaller determinations.

Another type of hybrid IC is family of chips employing digital signal processing (DSP). The explosion in telecommunications technology has driven a tremendous amount of progress in DSP chips and the speed demands have driven voltages downward just as in other types of processing. As the voltages have gotten smaller, the impact of noise in ICs, particularly in an environment where an acoustic signal the focus, has steadily gotten more important. One source of noise exacerbation is the innate high impedance of common voltage references.

Figure 1:
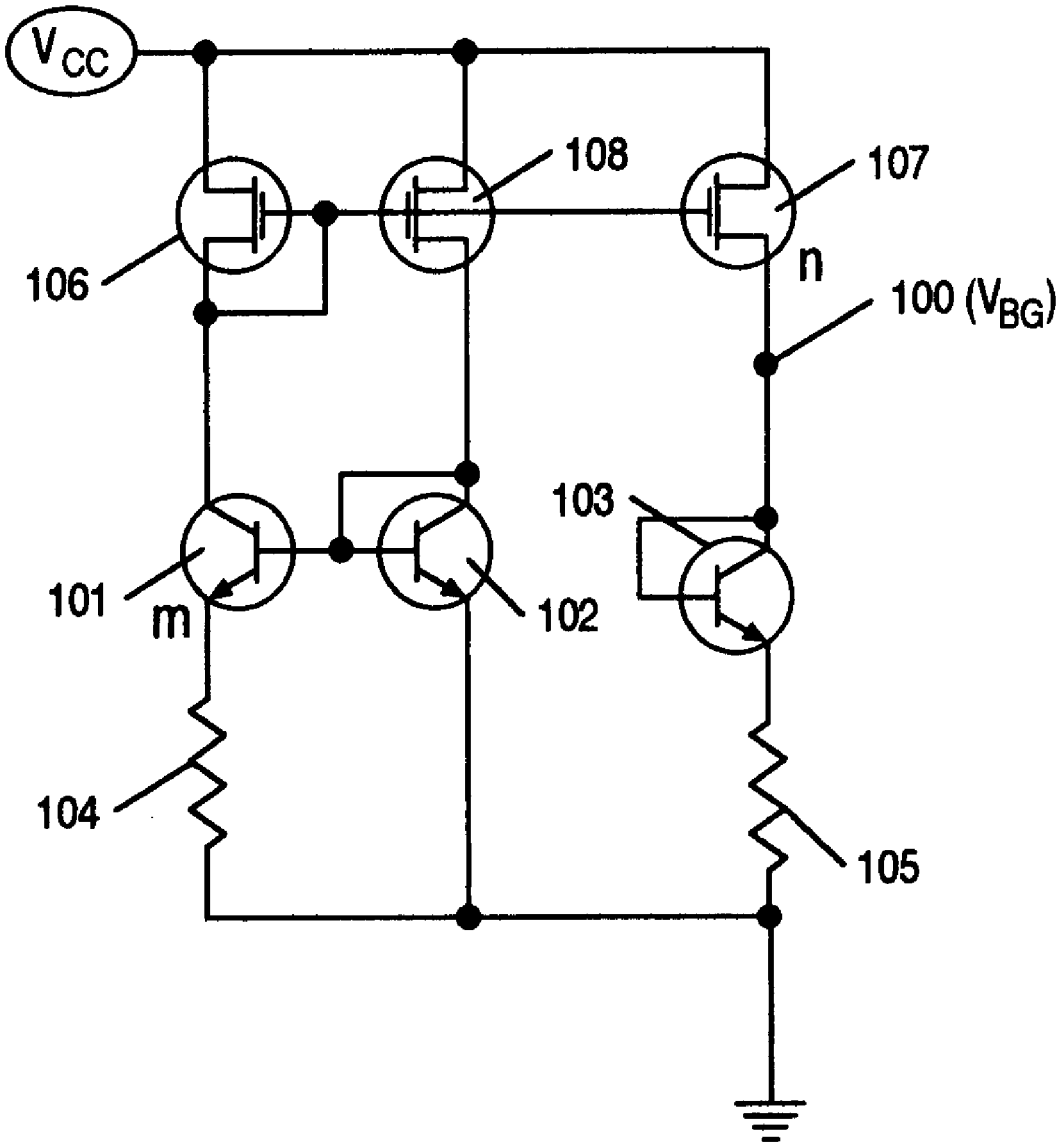
FIG. 1 illustrates an implementation of a band-gap reference circuit.
Figure 2:
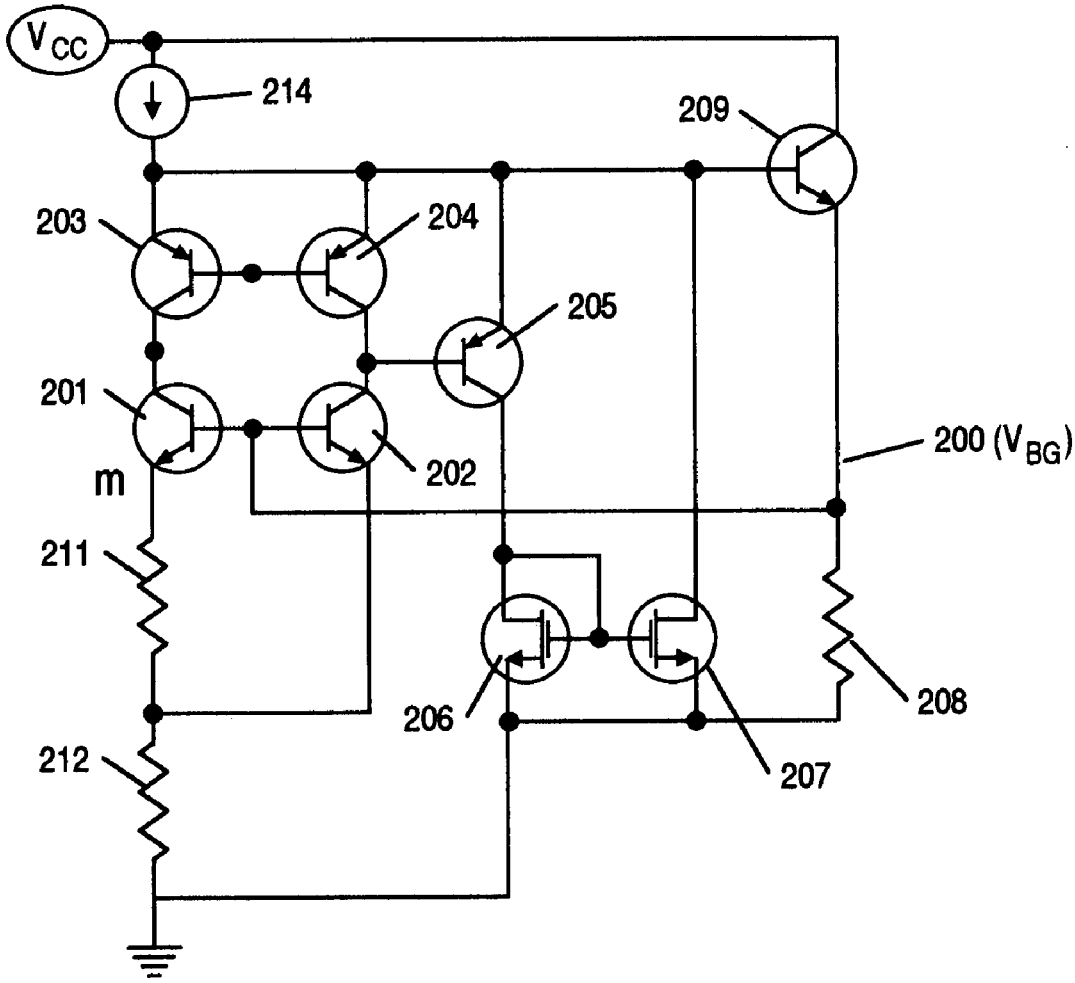
FIG. 2 illustrates an implementation of a band-gap reference circuit with an impedance reducing buffer consistent with the conventional art and with embodiments of the present invention.

One method of reducing noise in a reference circuit is by adding a buffer to the output of a band-gap reference. However, the addition of a buffer increases the power demand and can drive up the supply voltage required in order to maintain the band-gap voltage. FIG. 1 illustrates a basic band-gap reference circuit and FIG. 2 illustrates a reference with a buffer for noise suppression.

FIG. 1 is an illustration of a common Implementation of a band-gap reference circuit. The band-gap voltage at 100 is the sum of the current through transistor 107, multiplied by the resistance of resistor 105, and the base-emitter voltage ($V_{BE}$) of transistor 103. The current through transistor 107 is controlled by both its gate voltage, which is a function of the action of transistors 106 and 108, and the current diverted through resistor 104, which is controlled by the action of transistors 101 and 102. Transistors 106, 107 and 108 are connected in common at their gates with drains to supply voltage, $V_{CC}$. The gate to drain shunt of transistor 106 acts to regulate the gate voltages and the current of transistors 108 and 107.

Transistors 101 and 102 are both implemented as bipolar devices in this illustration. With its common base and collector, transistor 102 effectively acts as a base-emitter diode. Transistor 103 is also connected in a common base-collector form and also acts as a base-emitter diode.

It is the difference in currents between transistors 106 and 107 that produces the stable band-gap voltage. If $I_{106}$ is the current through transistor 106, that same current is through transistor 101 and resistor 104. In that case by Ohm's law, $I_{106}$ times $R_{104}$ equals the base-emitter voltage of transistor 102 minus the base-emitter voltage of transistor 101, i.e.:

$$I_{106} \cdot R_{104} = VBE_{102} - VBE_{101}$$

then $$I_{106} \cdot R_{104} = (V_T \ln m)/R_{104}$$

where: m is the relationship between transistor 101 and transistor 102 and m is larger than unity which means that transistor 101 is "bigger" than transistor 102. This in turn means that, for the same base-emitter voltage and the same emitter-collector voltage, transistor 101 will pass m times as much current as transistor 102.

The similar relationship between transistor 106 and transistor 107 is n. Transistors 106 and 107 are implemented as field effect transistors (FET) in this illustration. Transistor 107 will pass n times as much current as transistor 106 at the same gate-source voltage which is the constant state in the circuit illustrated because transistors 106 and 107 have common sources and common gates. If $i_2$ is the current through transistor 107 and $i_1$ is the current through transistor 106 and therefore transistor 101, $n=i_2/i_1$ and n is greater than or equal to 1. The current through transistors 108 and 102 is $i_3$.

The band-gap voltage at 100, then, is:

$$V_{BG} = I_2 \cdot R_{105} + V_{BE_{103}}$$

Note that, since transistor 103 is connected with a common base-emitter, it functions as a diode with an innate resistance.

Then:

$$V_{BG} = ni_1 R_{105} + V_{BE_{103}}$$

$$V_{BG} = [n(V_T \ln m)/R_{104}] \cdot R_{105} + V_{BE_{103}}$$

$$V_{BG} = [n(V_T \ln m)/R_{104}] \cdot R_{105} + V_T \ln(ni_1/i_s)$$

It must be noted here that the gate-drain shunt of transistor 106 causes the gate voltage of transistors 106, 107 and 108 to seek an equilibrium. The difficulty that arises in such a simple circuit is its inherent high impedance and attendant susceptibility to noise.

To overcome this, a buffer can be added to the band-gap circuit as is shown in FIG. 2. In essence the same circuit as in FIG. 1, the circuitry associated with transistors 201 through 207 and resistors 211 and 212 provides the same functionality as the circuitry in FIG. 1. The current source shown at 214 is implemented in this illustration as a MOSFET current source. PNP transistors 203 and 204 share a common base which is shunted to the collector of transistor 203. NPN transistors 201 and 202 also share a common base that connects $V_{BG}$, the band-gap voltage at 200. Transistor 205 has a base connected to the common collectors of transistors 202 and 204. The collector of transistor 205 is connected to the drain of transistor 206 which shares a common gate with transistor 207. The common gate of transistors 206 and 207 is shunted to the drain-collector connection between transistors 205 and 206. In the implementation illustrated in FIG. 2, m symbolizes the relationship in current flow between transistor 201 and transistor 202. Because their bases are common, the ratio of current flows is constant. The base-emitter voltage of transistor 201 and transistor 202 differs by the voltage across resistor 211.

The circuit in FIG. 2 differs primarily from that in FIG. 1 in the employment of transistor 209. Transistor 209 is implemented as an NPN bipolar device, which typically have significantly lower impedances than FETs. Transistor 209 is connected at its base to common emitters of transistors 203, 204 and 205 and with its collector connected to $V_{CC}$. This causes transistor 209 to behave as an emitter follower and function as a buffer. It is well known in the art that an emitter follower can accept a signal at a high resistance level without significant attenuation and reproduce it at a low resistance level and with no phase shift. Therefore, in this implementation, it functions well as a buffer. However, a problem that arises in the use of a buffer is the requirement for a higher supply voltage, Vcc, in order to preserve a constant band-gap voltage.

In the band-gap reference circuit illustrated in FIG. 2, the required Vcc can be defined as:

$$V_{CC} = V_{BG} + V_{BE_{209}} + V_{SOURCE_{214}}$$

where:

$V_{BG}$=1.25 V $V_{BE_{209}}$=700 mV $V_{SOURCE_{214}}$=300 mV thus:

$V_{CC} \geqq 2.25$ V

Figure 3:
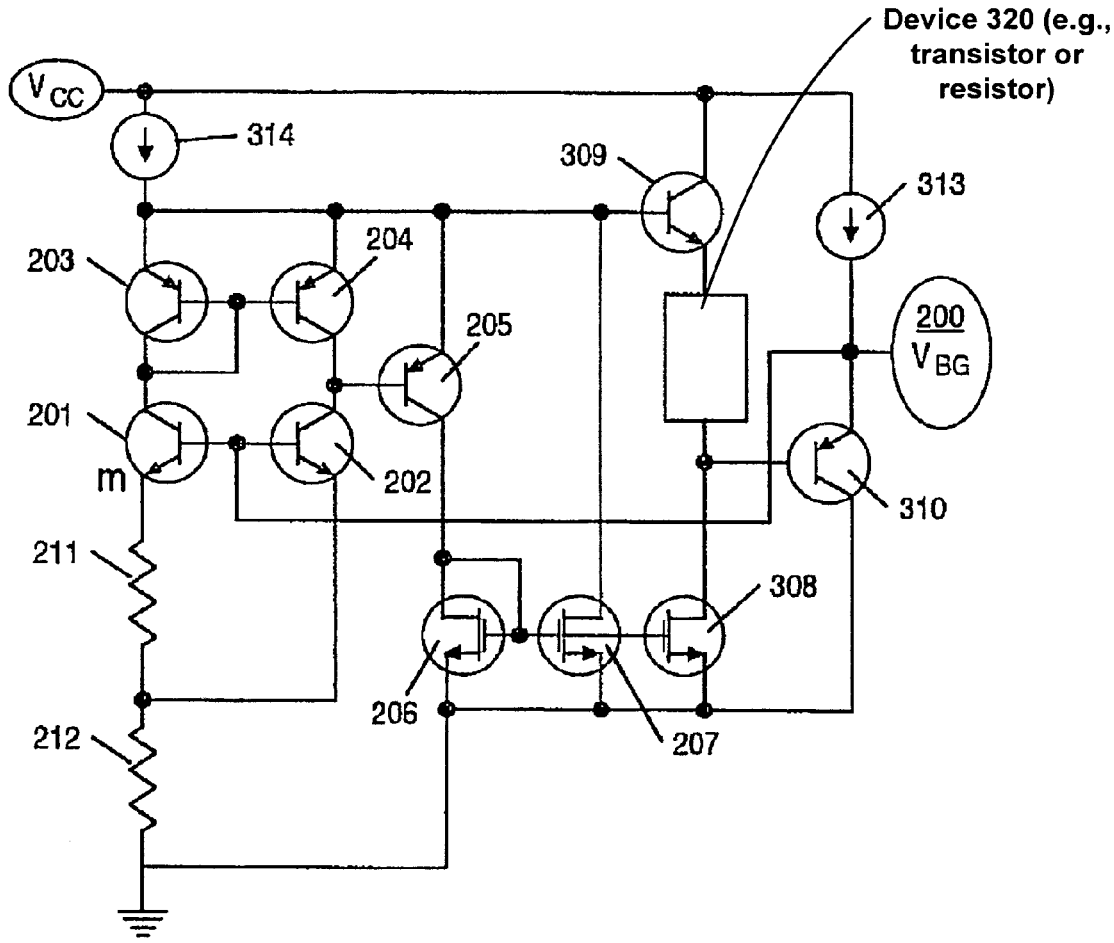
FIG. 3 illustrates a low-Z, low voltage, band-gap reference circuit in accordance with one embodiment of the present invention.

The embodiment of the present invention discussed here enables a low supply voltage Vcc, as is shown in FIG. 3, by the addition of device 320. Device 320 is accompanied by the addition of transistor 308, transistor 310 and current source 313. Current source 313 can be, in many implementations of this embodiment of the present invention, functionally implemented by a metal oxide/silicon field effect transistor (MOSFET) current source with its source connected to Vcc. NPN transistor 309 is connected as an emitter follower for the emitters of transistors 203, 204 and 205. The emitter of transistor 309 is connected via device 320 to the base of PNP transistor 310. It is transistor 310 that provides the final buffering in this implementation. The collector-emitter voltage, $V_{CE}$, of transistor 310 is the band-gap voltage in this embodiment. In this configuration, Vcc can be very low for a buffered band-gap circuit. The minimum $V_{CC}$ here is:

$$V_{CC}=V_{BG}-V_{BE_{310}}+V_{320}+V_{BE_{309}}+V_{SOURCE_{314}}$$

since:

$V_{BG}=1.25$ V $V_{BE_{310}}=V_{BE_{309}}$ then:

$$V_{CC}=V_{BG}+V_{320}+V_{SOURCE_{314}}\cong 1.8\text{ V}$$

Note that, in this embodiment, device 320 is necessary to pull the voltage back up and prevent saturation of transistors 201 and 202. Device 320 can be implemented, in various embodiments, as a resistor or as a transistor with less than 1 $V_{BE}$. In the illustration of FIG. 3, device 320 is disposed between buffer 309 and the band gap reference unit. It is important to note that transistors 203, 204, and 205 can be implemented as either bipolar transistors or MOS transistors.

Device 320, in this embodiment, can be implemented in a number of ways. It is likely that device 320 will be found to be functional when implemented as a resistor or as a fixed gain transistor. Without regard to the actual implementation, the function of device 320 remains to be the reduction in necessary supply voltage in order to produce a functional buffer across the operating range of the band-gap reference circuit. In the implementation of device 320 illustrated in FIG. 3, the combination of device 320 and buffering transistor 309 acts to pull the $V_{BE}$ of transistor 310 towards $V_{CC}$ which means that the buffering that is done by transistor 310 can be accomplished at a lower $V_{CC}$. In this fashion, the buffering necessary to achieve a low impedance is enabled yet the normally high $V_{CC}$ attendant to the implementation of buffering is obviated. A low voltage, low Z, band-gap reference circuit is thus embodied.

A novel band-gap reference circuit has been disclosed. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

We claim:

1. A band-gap reference circuit, comprising:

a band-gap reference unit comprising a first transistor, a second transistor and a third transistor, wherein said first and second transistors share a common base that is shunted to the collector of said first transistor and wherein said third transistor is coupled to the collector of said second transistor;

a buffer circuit coupled with said band-gap reference unit;

a voltage pull-up device coupled between said band-gap reference unit and said buffer circuit, wherein said voltage pull-up device is implemented as a fourth transistor; and a fifth transistor operable as an emitter follower for the emitters of said first, second and third transistors, wherein the emitter of said fifth transistor is coupled to the base of said buffer circuit via said voltage pull-up device, the base of said fifth transistor is coupled to each of the emitters of said first, second and third transistors, and the collector of said fifth transistor is coupled to Vcc; and wherein said fifth transistor and said voltage pull-up device in combination pull the $V_{BE}$ of said buffer circuit toward Vcc.

2. A band-gap reference circuit as described in claim 1, wherein said band-gap reference circuit resides in an integrated circuit device.

3. A band-gap reference circuit as described in claim 1, wherein said band-gap reference circuit is implemented in a silicon substrate.

4. A band-gap reference circuit as described in claim 1, wherein said buffer circuit is implemented as a sixth transistor.

5. An electronic device, comprising:

a silicon substrate;

electronic circuitry constructed in said silicon substrate; and a band-gap reference circuit comprising:

a band gap reference unit comprising a first transistor, a second transistor and a third transistor, wherein said first and second transistors share a common base that is shunted to the collector of said first transistor and wherein said third transistor is coupled to the collector of said second transistor, a buffer circuit, a voltage pull-up device coupled in said electronic device, and a fourth transistor operable as an emitter follower for the emitters of said first, second and third transistors, wherein the emitter of said fourth transistor is coupled to said buffer circuit via said voltage pull-up device, the base of said fourth transistor is coupled to each of the emitters of said first, second and third transistors, and the collector of said fourth transistor is coupled to Vcc; and wherein said fourth transistor and said voltage pull-up device in combination pull the $V_{BE}$ of said buffer circuit toward Vcc;

wherein said electronic circuitry requires reference to an output voltage of said band-gap reference circuit, wherein said buffer circuit comprises a fifth transistor, and wherein said voltage pull-up device is coupled between said band-gap reference unit and said buffer circuit.

6. An electronic device as described in claim 5, wherein said electronic device is an integrated circuit device.

7. An electronic device as described in claim 5, wherein said band-gap reference circuit is enabled for low supply voltage.

8. An electronic device as described in claim 7, wherein said band-gap reference circuit is enabled for said low supply voltage by said voltage pull-up device.

9. In an electronic device, a method for providing a reference voltage, comprising:

flowing current through an electronic element such that a band-gap voltage of said electronic element provides said reference voltage, said electronic element comprising a first transistor, a second transistor and a third transistor, wherein said first and second transistors share a common base that is shunted to the collector of said first transistor and wherein said third transistor is coupled to the collector of said second transistor;

providing a buffer circuit and a band gap voltage reference unit coupled to said buffer circuit; and adjusting voltage across said buffer circuit, by use of a voltage pull-up device in combination with a fourth transistor to pull the $V_{BE}$ of said buffer circuit toward Vcc, wherein said voltage pull-up device is coupled between said buffer circuit and said band gap voltage reference unit, so that said reference voltage is maintained, wherein said fourth transistor is coupled as an emitter follower for the emitters of said first, second and third transistors, wherein the emitter of said fourth transistor is coupled to the base of said buffer circuit via said voltage pull-up device, the base of said fourth transistor is coupled to each of the emitters of said first, second and third transistors, and the collector of said fourth transistor is coupled to Vcc.

10. A method as described in claim 9, wherein said electronic device is an integrated circuit device.

11. A method as described in claim 9, wherein said buffer circuit is implemented as a transistor circuit.

12. A method as described in claim 11, wherein said transistor circuit is connected as an emitter follower.

13. A method as described in claim 9, wherein said band-gap reference circuit is enabled for low supply voltage.

14. A method as described in claim 13, wherein said band-gap reference circuit is enabled for said low supply voltage by said voltage pull-up device.

15. A method as described in claim 14, wherein said reference voltage is provided by current through a transistor with a $V_{BE}$ of less than 1.0 volts.

16. A band-gap reference circuit as described in claim 1, further comprising a sixth, a seventh, an eighth and a ninth transistor coupled to said first, second and third transistors, wherein said sixth and seventh transistors share a common base that is coupled to $V_{BG}$, wherein said second and seventh transistors share a collector coupled to the base of said third transistor, wherein the collector of said third transistor is coupled to the drain of said eighth transistor, and wherein said eighth and ninth transistors share a gate that is shunted to the drain-collector connection between said third and eighth transistors.

* * * * *